United States Patent [19]

Ferris et al.

[11] 4,308,684

[45] Jan. 5, 1982

[54] TOY MOVIE CAMERA

[75] Inventors: Michael J. Ferris, Chicago; Harry Disko, South Barrington; Sam J. Cottone, Addison, all of Ill.

[73] Assignee: Marvin Glass & Associates, Chicago, Ill.

[21] Appl. No.: 208,695

[22] Filed: Nov. 20, 1980

[51] Int. Cl.[3] ..... A63H 33/30

[52] U.S. Cl. ..... 46/39; 46/175 R

[58] Field of Search ..... 46/39, 1 R, 174, 175 R, 46/192, 47; 40/364, 363; 352/129, 208, 219

[56] References Cited

U.S. PATENT DOCUMENTS

| | | | |
|---|---|---|---|
| 722,382 | 3/1903 | Pross | 352/219 |
| 1,151,977 | 8/1915 | Tanikawa | 352/208 X |
| 3,490,171 | 1/1970 | Crawford et al. | 46/1 R X |
| 3,953,104 | 4/1976 | Roitz et al. | 350/4.1 |

*Primary Examiner*—Robert Peshock

*Assistant Examiner*—Mickey Yu

*Attorney, Agent, or Firm*—Mason, Kolehmainen, Rathburn & Wyss

[57] ABSTRACT

The toy movie camera of the present invention comprises a housing having aligned viewing apertures in opposite wall portions separated by a manually rotatable opaque disc having one or more slots or apertures therein capable of being aligned with the housing viewing apertures, periodically and controllably, by manual rotation of the disc within the housing. A click sounder is also included for producing a click sound only when the disc aperture is approximately in alignment with the housing viewing apertures. The click sounder includes a spring biased strip to be intermittently contacted by a pin mounted on an axle and rotated with the disc. The disc aperture is located relative to the pin position and to be out of alignment with the housing viewing apertures when the pin is biased by the spring biased strip.

5 Claims, 4 Drawing Figures

Fig 1
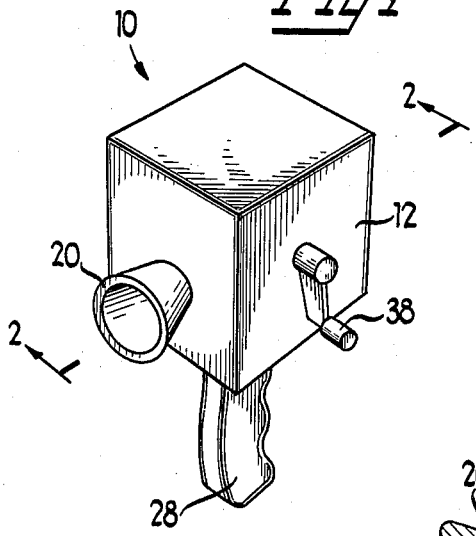
Fig 2
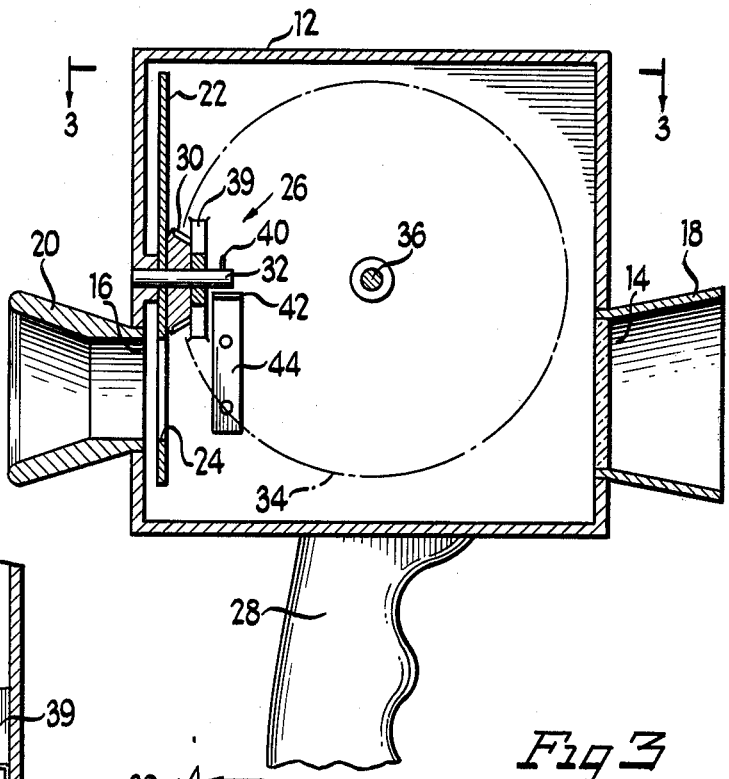
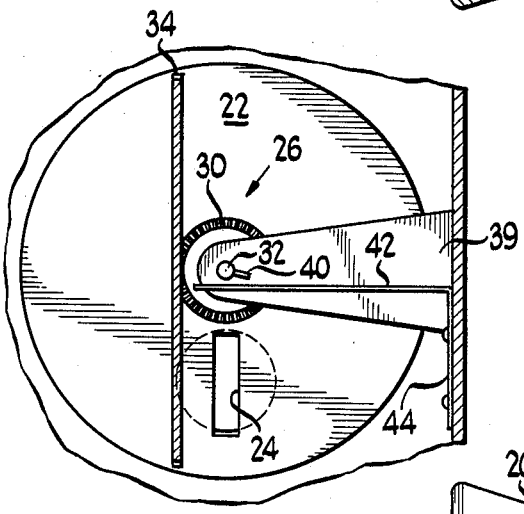
Fig 4
Fig 3
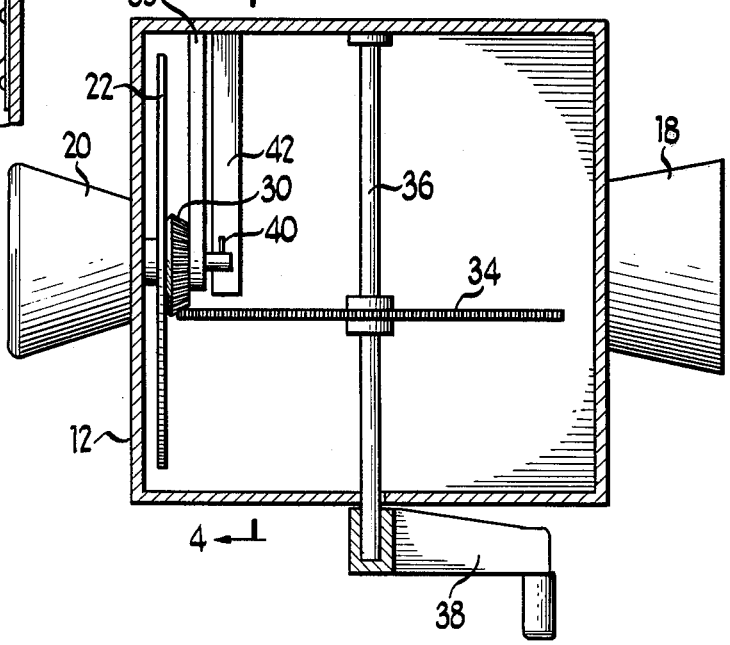

TOY MOVIE CAMERA

FIELD OF THE INVENTION

The present invention relates to an amusement device and more particularly to an amusement device made in the form of a toy movie camera including an inner rotatable opaque disc containing one or more viewing apertures. The disc is manually rotated to provide a visual strobe-type effect as a disc aperture repeatedly aligns with aligned apertures in the camera housing during disc rotation.

SUMMARY OF THE INVENTION

In brief, the amusement device of the present invention comprises a housing having aligned viewing apertures in opposite wall portions separated by a manually rotatable opaque disc having one or more slots or apertures therein capable of being aligned with the housing viewing apertures, periodically and controllably, by manual rotation of the disc within the housing.

An object of the present invention is to provide a new and improved toy movie camera.

Another object of the present invention is to provide a new and improved amusement device in the form of a movie camera including a camera-shaped housing having aligned viewing apertures in a front and rear portion of the housing and a manually rotatable disc within the housing having one or more slots or apertures capable of periodic alignment with the viewing apertures by manual rotation.

BRIEF DESCRIPTION OF THE DRAWING

FIG. 1 is a perspective view of the new and improved amusement device constructed in accordance with the present invention;

FIG. 2 is an enlarged cross-sectional view of the new and improved amusement device taken through the line 2—2 of FIG. 1;

FIG. 3 is a partially elevational, cross-sectional view taken through the line 3—3 of FIG. 2; and FIG. 4 is a partially broken away, cross-sectional view taken through the line 4—4 of FIG. 3.

DETAILED DESCRIPTION OF A PREFERRED EMBODIMENT

Turning now to the drawing, there is illustrated a new and improved amusement device constructed in the form of a movie camera generally designated by reference numeral 10. The amusement device generally includes a rectangular housing 12 having front and rear aligned viewing apertures 14 and 16, respectively in opposite housing walls. The viewing apertures 14 and 16 are surrounded by outwardly extending generally truncated cone-shaped simulated lens housings 18 and 20, respectively. The camera housing 12 contains an opaque manually rotatable disc 22 including one or more slots or apertures 24 capable of being intermittently aligned with the front and rear housing apertures 16 and 18, as shown in FIG. 2, such as by rotation, and a gear mechanism generally designated by reference numeral 26 for manual rotation of the opaque disc 22. A handle 28 extending outwardly from the housing 12 is manually turned to rotate the internal disc 22.

The gear mechanism, generally designated by reference numeral 26 (as best shown in FIG. 4) includes a beveled gear 30 longitudinally aligned with the opaque, i.e., black, disc 22 over a pin or axle 32 and the beveled gear 30 is operatively connected through a transverse, large, flat or plain gear 34 to a crank or axle 36 extending outwardly from the housing and attached to a crank handle 38. The beveled gear 30 and axle 32 are secured in position with a gear support member 39 secured to an inner housing wall, as best shown in FIG. 4. The axle 32 is rotatable within an aperture in the gear support member 39. Rotation of crank handle 38 in a clockwise direction causes corresponding clockwise rotation of the crank 36 and large plain gear 34 thereby causing counterclockwise rotation of the beveled gear 30, the beveled gear axle 32, and the opaque disc 22 to cause intermittent, periodic alignment of the disc slot 24 with the front and rear viewing apertures 14 and 16, as shown in FIG. 2, to permit the user to see entirely through the camera housing 12.

Axle 32 for beveled gear 30 is provided with a transversely extending pin 40. A flexible plastic strip 42 is mounted within the housing 12 to extend transversely from an interior housing wall. The plastic strip is secured to a housing wall at one end of the strip and is disposed within striking distance of the pin 40. The plastic strip is secured in alignment with the axle pin 40 so that rotation of the axle 32 will cause the axle pin 40 to strike intermittently against the plastic strip 42 to simulate a movie camera noise as the disc 22 is rotated, the amount of noise being proportional to the speed of rotation of the outwardly extending handle 38. The plastic strip 42 is mounted to the inner housing wall by any suitable bracket 44.

While, it has been found that the flat edged gear 34 provides effective mating contact with beveled gear 30 to cause non-slipping rotation of beveled gear 30, a complementary bevel gear could be similarly used. The strobe effect resulting from the rotation of handle 38 causes a moving image, viewed through the viewing apertures 14 and 16, to appear to the user to be discontinuous, sudden and broken movement similar to an old-time movie. The first motion pictures were made at fewer frames per second than current movies. Presently, movies are made at, at least, 24 frames per second. Older movie contained many fewer frames per second, such as, for example, 8-10 frames per second. This caused the individual frames to read images which lost substantial movement in between respective frames resulting in the apparent jerky movements. The present invention simulates this effect in the toy movie camera previously described.

What is claimed is:

1. An amusement device in the form of a toy camera, comprising:

a housing including means defining two aligned housing apertures in opposite sides of said housing and defining a light receiving passageway controllably connecting said apertures;

opaque means for intermittently obstructing said light receiving passageway for intermittently and controllably preventing light received in one housing apertures from being transmitted directly into said second housing aperture, said opaque means including an opaque panel disposed within said passageway, said panel defining a panel aperture and further including means for disposing said panel aperture in alignment with said two housing apertures;

means for intermittently and controllably removing said opaque obstructing means from said light receiving passageway to intermittently and controllably permit light received in said one housing aperture to be transmitted directly into said second housing aperture, said removing means further including means for rotating said panel to intermittently and repeatedly dispose said panel aperture in alignment with said two housing apertures; and means for producing a click sound only when said panel aperture is approximately in alignment with said two housing apertures, said sound producing means including a spring biased strip disposed within said housing to intermittently contact a portion of said means for removing said opaque obstructing means from said light passageway and to bias said panel out of a position with its panel aperture approximately in alignment with said light passageway.

2. An amusement device as defined in claim 1 wherein said rotation means comprises a manually rotatable handle extending outwardly from said housing and operatively connected through an internal gear mechanism to said panel.

3. An amusement device as defined in claim 2 wherein said gear mechanism comprises a beveled gear operatively connected to said panel, and a substantially square-cornered gear operatively connecting said beveled gear to said outwardly extending handle.

4. An amusement device as defined in claim 1, the amount of noise generated by said sound producing means being proportional to the frequency said opaque obstructing means is disposed to obstruct and removed from obstructing said light receiving passageway.

5. An amusement device as defined in claim 4 wherein said opaque obstructing means comprises an opaque disc, rotatable about an axle to align a disc aperture with said two housing apertures to provide a substantially unobstructed light passageway, said axle including an elongated noise generating member extending from said axle disposed in close proximity to said strip so that rotation of said axle causes intermittent contact of said elongated noise generating member against said flexible strip to generate intermittent noise proportional to the frequency of rotation of said axle.

* * * * *